United States Patent [19]

Mowbray et al.

[11] 4,300,873

[45] Nov. 17, 1981

[54] FUEL INJECTION SYSTEMS

[75] Inventors: Dorian F. Mowbray, Burnham; Boaz A. Jarrett, Chiswick, both of England

[73] Assignee: Lucas Industries Limited, Birmingham, England

[21] Appl. No.: 94,904

[22] Filed: Nov. 16, 1979

[30] Foreign Application Priority Data

May 12, 1979 [GB] United Kingdom ..... 16562/79

[51] Int. Cl.³ ..... F04B 17/04

[52] U.S. Cl. ..... 417/416; 123/467

[58] Field of Search ..... 417/416, 415, 399, 398, 417/499; 123/467, 499; 141/128

[56] References Cited

U.S. PATENT DOCUMENTS 2,029,780 2/1936 Mazer et al. ..... 417/416
2,568,757 9/1951 Mesh ..... 417/416
2,576,451 11/1951 Dickson et al. ..... 417/499 X
3,753,426 8/1973 Lilley ..... 123/457 X

FOREIGN PATENT DOCUMENTS 318461 2/1933 Italy ..... 417/494

*Primary Examiner*—William L. Freeh
*Assistant Examiner*—Edward Look

[57] ABSTRACT

A fuel injection system includes a pumping plunger contained in a cylinder and actuated in a direction to pump fuel from the cylinder by energization of an electromagnetic device including an armature. Stop means is provided to limit the movement of the armature when the device is energized and this includes a high rate spring constituted by a dished washer which is compressed by the armature during the final movement thereof. The washer is sufficiently strong to urge the armature in the opposite direction against the magnetic forces produced by the device, by an amount sufficient to bring about a reduction in the pressure in the cylinder.

5 Claims, 1 Drawing Figure

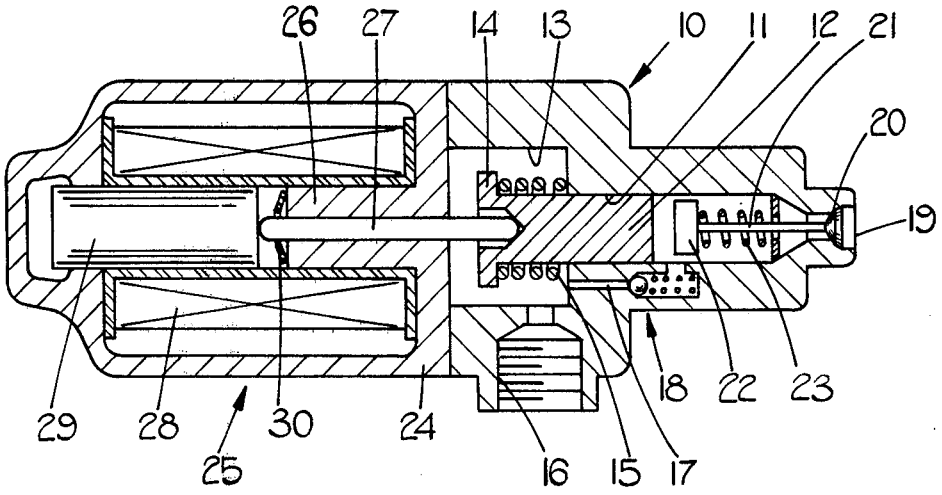
26
27
14
13
10
11
12
21
20
19
29
28
25
30
24
16
15
17
18
22
23

FUEL INJECTION SYSTEMS

This invention relates to a fuel injection system of the kind comprising a pumping plunger slidable within a cylinder, an electromagnetic device including an armature for effecting movement of the pumping plunger in a direction to displace fuel from the cylinder and a fuel inlet to the cylinder through which fuel can flow into the cylinder during the the return motion of the pumping plunger when the electromagnetic device is de-energised.

Such a system in use will have the one end of the cylinder communicating with a fuel injection nozzle which embodies a pressure responsive valve. It is known that in order to avoid dribble of fuel from the nozzle at the end of the pumping stroke of the pumping plunger, the fuel pressure at the nozzle should be reduced as rapidly as possible in order that the valve member can close as quickly as possible. With more conventional systems this reduction in pressure is brought about by spilling fuel from the cylinder or where spillage of fuel does not occur, by shaping the actuating cam of the pumping plunger.

It is an object of the present invention to provide a system of the kind specified in a form in which a rapid reduction in the pressure of fuel in the cylinder at the end of the pumping stroke of the pumping plunger, is obtained.

According to the invention a system of the kind specified includes stop means for limiting the movement of said armature when the electromagnetic device is energised, said stop means including a high rate resilient means which is compressed during the final movement of the armature towards said stop means but which is sufficiently strong to urge the armature in the opposite direction against the action of the magnetic forces produced by the electromagnetic device, by an amount sufficient to bring about a reduction in the fuel pressure in said cylinder.

One example of a fuel injection system in accordance with the invention will now be described with reference to the accompanying diagramatic drawing. The device shown in the drawing is a combined pump and injector and it comprises a main body portion 10 having a stepped cylindrical outer surface. Formed within the body portion is a cylinder 11 in which is located a pumping plunger 12. The pumping plunger extends into an enlarged recess 13 defined in the body portion 10 and the plunger is provided with a peripheral flange 14 against which is located one end of a coiled compression spring 15. The other end of the spring 15 engages with a wall of the recess. Extending into the recess is a fuel inlet 16 for connection in use to a source of liquid fuel and leading from the recess is a passage 17 which communicates with the cylinder 11 at a position beyond the inner most position of the plunger 12. Incorporated in the passage 17 is a spring loaded ball valve 18.

The cylinder 11 extends to an outlet 19 which in use, will open into a combustion chamber of the associated engine. For controlling the flow of fuel through the outlet 19 there is provided a valve which includes a valve head 20 engageable with a seating defined about the outlet. The head 20 is connected to a stem 21 which extends into the cylinder 11 and at its end remote from the head is provided with an abutment 22 against which acts a coiled compression spring 23. The spring 23 acts to urge the head of the valve member into contact with its seating and the valve member is lifted from its seating upon an increase in the fuel pressure within the cylinder created as a result of movement of the pumping plunger 12 against the action of the spring 15.

Located against the larger end of the body portion 10 is the housing 24 of an electromagnetic device generally indicated at 25. The housing 24 closes the open end of the recess 13 and conveniently is formed from magnetisable material. The housing defines a central pole member 26 in which is formed a drilling which communicates with the recess 13 and in which is located a slidable push member 27. One end of the push member is located within a recess formed in the flanged end of the pumping plunger 12 whilst the other end of the push member extends beyond the end of the pole member 26. Surrounding the pole member is an annular winding 28 which is wound about a former located about the pole member 26. The former provides a bearing surface for an armature 29 which is formed from magnetisable material and which passes with a small clearance, through an aperture in the end portion of the housing 24.

In use, when electric current is supplied to the winding 28 the armature 29 will move towards the pole member 26 and in so doing will impart axial movement to the push member and also the pumping plunger. Such movement of the pumping plunger will pressurise the fuel contained within the cylinder 11 and when a sufficiently high pressure is attained the valve head 20 will be lifted from its seating and a flow of fuel will occur into the combustion space of the engine. When the winding is de-energised the spring 15 will return the plunger, the push rod and the armature to the initial position and furthermore, fuel will flow into the cylinder by way of non-return valve 18. The valve head 20 will close onto its seating when the pressure in the cylinder is reduced.

It is convenient for the purpose of operating the system to supply a high level of current to the winding 28 to achieve delivery of fuel and as soon as delivery has taken place, to hold the armature against the action of the spring 15 utilising a reduced current flow in the winding 28. In practice the level of current is reduced from the high level before the armature reaches the end of its travel. However, inertia and the fact that the magnetic flux does not die away immediately ensure that the armature moves to the end of its travel together with the pump plunger. When a further injection of fuel is required the winding is de-energised completely to permit fuel to flow into the cylinder 11 and in so doing to displace the pumping plunger, push rod and armature. The time allowed for such flow of fuel is carefully calculated knowing the rate of fuel flow into the cylinder. After a predetermined time the winding is fully energised to effect a further delivery of fuel.

As previously stated it is essential that the valve head 20 should close onto the seating quickly to avoid dribble of fuel and this can only be achieved by rapidly reducing the pressure in the cylinder.

In order to achieve the rapid reduction in pressure, stop means which comprises a high rate spring is provided to limit the movement of the armature 29. The spring is constituted by a dished washer 30 which is located against the end face of the pole member 26. The push member extends with clearance through an aperture in the washer and the arrangement is such that when the winding 28 is fully energised to achieve injection of fuel, the force exerted on the armature is sufficient to cause movement of the plunger in a manner to generate the fuel pressure against the force exerted by the spring 15. When the current is reduced the armature continues to move and is halted by the washer 30 which is compressed in the process. The lower level of current is however insufficient to hold the armature against the resilience of the washer 30. As a result the armature is moved a limited amount by the washer 30 and the plunger and the push rod 27 move a similar amount so that the pressure within the cylinder falls quickly and the valve head 20 can move quickly onto the seating.

We claim:

1. A fuel injection system comprising a pumping plunger slidable within a cylinder, an electromagnetic device including an armature for effecting movement of the pumping plunger in a direction to displace fuel from the cylinder, an outlet valve for controlling the flow of fuel from said cylinder, a fuel inlet to the cylinder through which fuel can flow into the cylinder during the return motion of the pumping plunger when the electromagnetic device is de-energised, an inlet valve for controlling the flow of fuel through said fuel inlet, stop means for limiting the movement of said armature when the electromagnetic device is energised, said stop means including a high rate resilient means which is compressed during the final movement of the armature towards said stop means but which is sufficiently strong to urge the armature in the opposite direction against the action of the magnetic forces produced by the electromagnetic device, by an amount sufficient to bring about a reduction in the fuel pressure in said cylinder.

2. A system according to claim 1 including further resilient means acting on the plunger for effecting the return motion of the plunger when the electromagnetic device is de-energised.

3. A system according to claim 2 in which the high rate resilient means comprises a dished washer.

4. A system according to claim 3 in which said dished washer is located against an end face of a pole member forming part of the electromagnetic device, and including a push member positioned between the armature and the plunger, said push member passing through an aperture in the dished washer and through a drilling in the pole member.

5. A system according to claim 4 in which said fuel inlet incorporates a non-return valve.

* * * * *